US007536991B2

(12) United States Patent
Kadam et al.

(10) Patent No.: US 7,536,991 B2
(45) Date of Patent: May 26, 2009

(54) FUEL INJECTION FOR SMALL ENGINES

(75) Inventors: Vishalsinh V. Kadam, Sanford, NC (US); Saurabh V. Gandhe, Apex, NC (US); Steven Eason, Sanford, NC (US); Carlos F. Damasceno, Chapel Hill, NC (US)

(73) Assignee: Magneti Marelli Powertrain USA, Sanford, NC (US)

( * ) Notice: Subject to any disclaimer, the term of this patent is extended or adjusted under 35 U.S.C. 154(b) by 0 days.

(21) Appl. No.: 11/774,925

(22) Filed: Jul. 9, 2007

(65) Prior Publication Data

US 2009/0018750 A1 Jan. 15, 2009

(51) Int. Cl.
*F02D 9/08* (2006.01)
*F02D 9/10* (2006.01)

(52) U.S. Cl. ..... 123/337

(58) Field of Classification Search ..... 123/337, 123/472, 470, 468, 469, 198 E, 399
See application file for complete search history.

(56) References Cited

U.S. PATENT DOCUMENTS

| | | | | |
|---|---|---|---|---|
| 4,204,507 | A * | 5/1980 | Casey et al. | 123/470 |
| 4,347,822 | A * | 9/1982 | Casey | 123/445 |
| 4,400,974 | A * | 8/1983 | Nishimura et al. | 73/114.34 |
| 6,067,953 | A * | 5/2000 | Bloomer | 123/198 E |
| 6,494,186 | B1 * | 12/2002 | Wakeman | 123/479 |
| 6,866,027 | B1 * | 3/2005 | Marchesini et al. | 123/480 |
| 7,047,939 | B2 * | 5/2006 | Sakurai et al. | 123/399 |
| 7,128,056 | B2 * | 10/2006 | Kondo | 123/470 |
| 7,168,401 | B2 * | 1/2007 | Johnson | 123/73 A |
| 2003/0024505 | A1 * | 2/2003 | Anschicks et al. | 123/399 |
| 2004/0078134 | A1 * | 4/2004 | Yin et al. | 701/104 |
| 2005/0056261 | A1 * | 3/2005 | Marchesini et al. | 123/480 |

OTHER PUBLICATIONS

Tractors, Walker Mowers, www.walkermowers.com, Apr. 6, 2007, pp. 1-4.

MT26 EFI Details, Walker Mowers, www. walkermowers.com, Apr. 6, 2007.

New Generation Gasoline Generators From Kohler Reduce Carbon Monoxide Emissions by 99 Percent, Kohler Power Systems, www. kohlerpowersystems.com, Aug. 2005, pp. 1, 2.

Electronic Fuel Injection—Products—from Kohler Engines, Diesel Progress North America Edition, Find Articles, www.findarticles. com, Nov. 2001.

(Continued)

*Primary Examiner*—Mahmoud Gimie
(74) *Attorney, Agent, or Firm*—Locke Lord Bissell & Liddell, LLP

(57) ABSTRACT

The present invention is a fuel injection system for small engines in which the fuel injection system takes the place of traditional carburetors and provides the engine with air, fuel and spark control. The fuel injection system is comprised of an electronic control unit (ECU) coupled with a throttle body, which has an integrated fuel injector. The ECU controls the amount of air that enters a cylinder by controlling the throttle plate, and the ECU controls the amount of fuel entering the air flow by controlling the injector. This fuel injection system offers to smaller engines the many advantages of fuel injected engines over carbureted engines such as increased fuel economy, better cold starting capabilities, lower outputs of harmful emissions and lower engine operating temperatures.

17 Claims, 4 Drawing Sheets

OTHER PUBLICATIONS

EFI hits the small engine market—electronic fuel injection—includes related articles on Walker Mfg Co. and Robert Bosch Corp. products, Diesel Progress North American Edition, www. findarticles.com, Jul. 1998, pp. 1-3.

Single Ear Position Sensors, CTS Automotive Products, 500 Series, www.ctscorp.com, Feb. 6, 2001.

* cited by examiner

FUEL INJECTION FOR SMALL ENGINES

BACKGROUND OF THE INVENTION

1. Field of the Invention

This invention relates to a fuel injection system for small engines, which will provide an engine air, fuel and spark control and bring the advantages of fuel injection to small engines including fuel economy, cold start, emission control and protect the engine from overheating.

2. Description of Related Art

Fuel injection systems for larger internal combustion engines, such as found in automobiles, are known in the prior art. Traditionally, engines employed the use of carburetors to control the amount of air and fuel that entered the combustion chambers. Electronic fuel injection systems were introduced and first used in automobiles around 1980. An engine with fuel injection does not have a traditional carburetor as the fuel injection system replaces and performs the same functions as the carburetor performed. Fuel-injected engines offer many advantages over carbureted engines such as increased fuel economy, better cold starting capabilities, lower outputs of harmful emissions and lower engine operating temperatures.

Fuel injection systems are more expensive than traditional carburetors, so it has been cost prohibitive to incorporate fuel injection into smaller, one or two cylinder engines such as are used in lawnmowers, generators, small bikes and other similar machines and equipment.

It is therefore desirable to have a fuel injection system for small engines that offers all of the advantages of fuel injection over traditional carbureted engines, while having a low enough cost to make the system cost effective for small engine usages.

SUMMARY OF THE INVENTION

The present invention is a fuel injection system for small engines having between one and four cylinders in which the fuel injection system takes the place of traditional carburetors and provides the engine with air, fuel and spark control. The fuel injection system preferably comprises a polymeric housing, which houses an electronic control unit (ECU) and a throttle body, a fuel pump and a fuel rail. The polymeric housing comprises an ECU case and a throttle body portion, which are releasably engageable with each other.

The ECU case preferably comprises an ECU, a cover with heat dissipation capability, a built-in temperature sensor, throttle position controller, ignition driver, throttle position sensor and fuel pump pressure control. The ECU is responsible for electronically controlling the throttle body through the throttle position controller to regulate the amount of air and fuel that enter the cylinder(s) of the engine and also controls the timing of the spark through the ignition driver, which is used to control the ignition of the air/fuel mixture. The ECU controls the throttle body to increase the fuel efficiency of the engine, lower the harmful emissions of the engine and helps the engine maintain a lower operating temperature.

The throttle body portion of the polymeric housing comprises a selectively positionable throttle, a contactless throttle position sensor and an integrally mounted injector. The positionable throttle, which comprises a throttle plate that is rotatable in an air shaft running through the throttle body portion, is moved by a DC motor attached to a worm gear that in turn is attached to a sector gear, which is attached to the shaft running through the throttle plate. The ECU controls the rotation of the DC motor, which in turn is ultimately controlling the position of the throttle plate, and the sector gear has an integrated throttle position sensor, which is used to determine the position of the throttle plate. The position of the throttle plate is relayed back to the ECU, which then determines how much and in which direction to rotate the DC motor to move the throttle plate to the desired position. In addition, there is an external operator input sensor, which is attached by a cable to an operator input, such as a gas pedal or engine speed control. The user of the engine pushes the gas pedal or selects the desired engine speed control, which is relayed to the operator input sensor by the cable. Alternatively, electronic activation can be used to signal the operator's desired engine speed to the operator input sensor rather than a mechanical linkage. The operator input sensor signals to the ECU how much throttle or engine speed the user desires. The ECU sends the signal to the DC motor to position the throttle plate at the position that corresponds to the user's desired amount of throttle or engine speed.

The integrally mounted injector on the throttle body is used to inject fuel into the air supply, which is controlled by the throttle plate. The injector is in fluid communication with the fuel pump via the fuel rail. The fuel pump comprises a polymeric body that is attachable to and is an integral part of the throttle body housing, or it can be a separate piece as has been traditionally used. The fuel pump provides fuel under pressure to the fuel rail, which delivers the fuel to the injector. In a preferred embodiment, the fuel rail is also polymeric. The ECU controls the fuel flow by controlling when the injector opens and for how long it stays open, thus controlling the amount of fuel that is injected into the air flowing around the throttle plate and through the air shaft. In the preferred embodiment, only one injector is used for both one-cylinder and two-cylinder engines. The ECU can also control other injectors located in other positions away from the case, such as in the valves port. The use of only one injector, even on multi-cylindered engines, is part of the cost savings associated with this design. Further cost savings are achieved through the use of a polymeric molded throttle body rather than from a traditional, more-expensive metal one.

An integrated speed control or governor can also be incorporated into the ECU, which limits the throttle to a predetermined position regardless of the input from the user to protect the system from over revolutions. It is also understood that the ECU can adjust the fuel flow automatically based on the operating altitude of the engine. The ECU can also control can control the pump speed of ordinary fuel pumps or can control the fuel flow and pressure when the fuel pump is a pulse pump type. The fuel injection system of the present invention also offers flex fuel capability, which allows the system to be automatically and simultaneously used with both gasoline, ethanol or a blend of the two without the need of an additional flex sensor. Flex fuel capability is achieved through the selection of appropriate flex fuel materials, such as stainless steel, and by coating the components with a flex fuel appropriate coating, achieved through an anodization process. The ECU can automatically adjust fuel flow for optimal fuel efficiency depending on whether the fuel is gasoline, ethanol or a blend thereof. Another advantage of the present invention is its ability to be directly and releasably attachable to the intake manifold of a one or two-cylinder engine in a space that is otherwise provided for a carburetor. The novel features and construction of the present invention will be understood more fully from the following description when read in connection with the accompanying drawings.

BRIEF DESCRIPTION OF THE DRAWINGS

The improved process of the invention is further described and explained in relation to the following figures of the drawings wherein.

Like reference numerals are used to describe like parts in all figures of the drawings.

DESCRIPTION OF THE PREFERRED EMBODIMENTS

Figure 1:
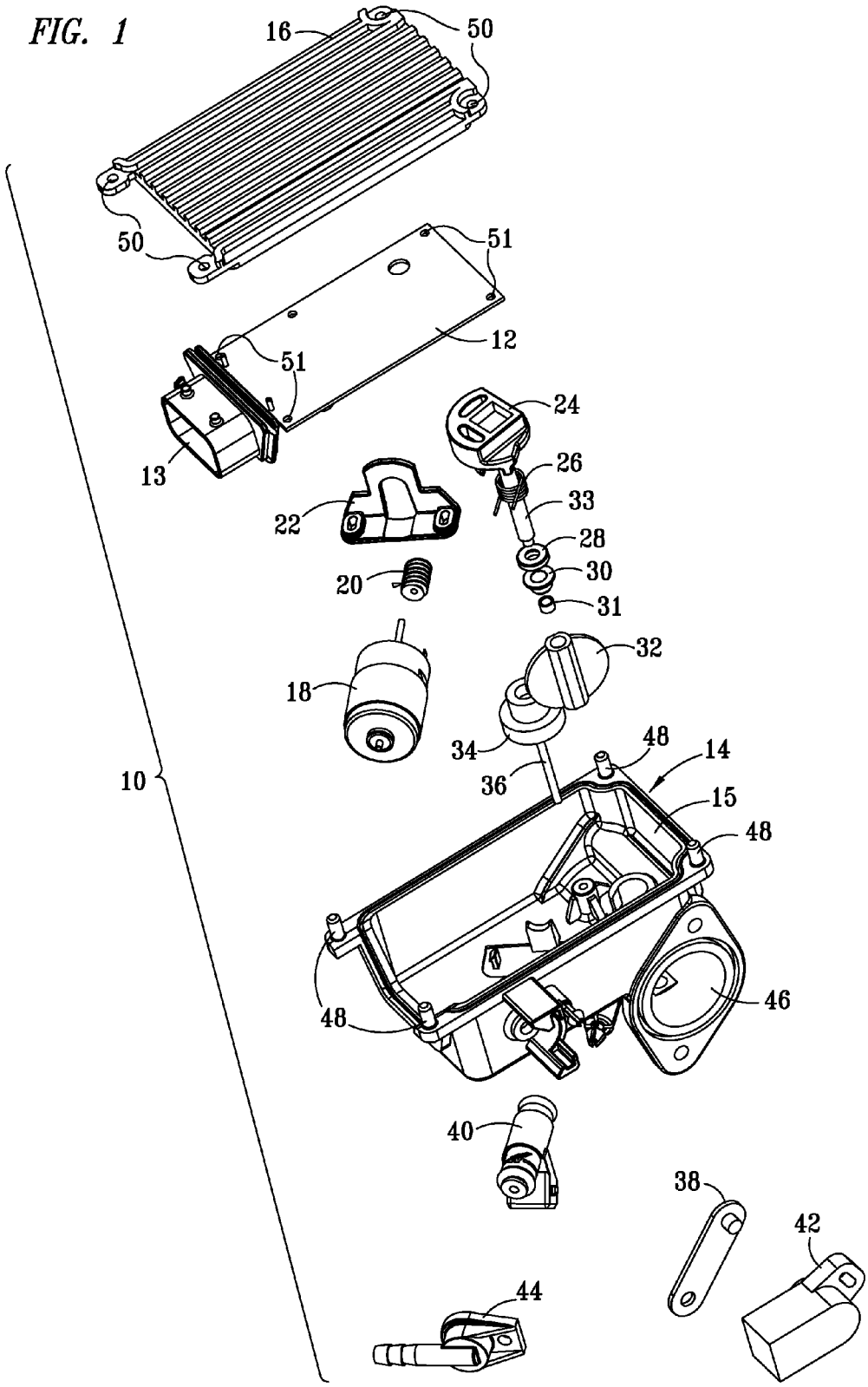
FIG. 1 is an exploded view of a fuel injection system made in accordance with the preferred embodiment of the disclosed invention.

Referring to FIG. 1, a preferred embodiment of fuel injection system 10 is shown, which principally comprises electronic control unit (ECU) 12, throttle body 14 with integrated injector 40, and fuel rail 44. ECU 12 is releasably attachable to throttle body housing 15 due to pins 48 on throttle body housing 15 aligning with corresponding holes 50 on ECU cover 16 and holes 51 on ECU. Once ECU 12, ECU cover 16 and throttle body housing 15 are aligned, the pieces are preferably attached by the use of screws (not shown), but other known attachment mechanisms such as rivets can also be used. ECU cover 16 is preferably made of a heat dissipation material such as aluminum or plastic with an appropriate design to dissipate heat away from ECU 12. ECU 12 receives its power through electrical connector 13. ECU further comprises built-in temperature sensor (not shown) to ensures the engine is not over-heating, throttle position controller (not shown) to ultimately control throttle plate 32, as discussed in more detail below, and ignition driver (not shown) to control the timing of the spark.

Throttle body 14 is housed in throttle body housing 15, which has attached air shaft 46 and is preferably constructed of a molded thermoplastic to reduce costs over traditional metal throttle body housings. Throttle body 14 comprises DC motor 18, worm gear 20, motor support 22, sector gear 24, spring 26, throttle shaft 33, throttle plate 32, double gear 34 and double gear pin 36. Motor support 22 is attached to throttle body housing 15 and holds DC motor 18 in place. As DC motor 18 rotates, worm gear 20 is turned, which in turn rotates sector gear 24. As sector gear 24, spring 26 is compressed and throttle shaft 33 is rotated. Spring 26 helps rotate throttle shaft 33 back to its original position after shaft 33 has been rotated. Lip seal 28 is located between spring 26 and throttle bushing 30 and prevents air from flowing out of air shaft 46. Bushing 30 in conjunction with bearing 31 connects throttle plate 32 to throttle shaft 33. Throttle plate 32 is located in air shaft 46 and can rotate ninety degrees from a closed position, in which throttle plate 32 prevents air from flowing through air shaft 46 by being perpendicular to air flow through air shaft 46, to a full-open position, in which throttle plate 32 is parallel to air flow through air shaft 46 and does not impede the air. Throttle plate 32 is selectively positionable at any angle between closed position and full-open position to assure the desired power or engine speed. Throttle body 14 further comprises integrated injector 40, which is positioned in throttle body housing 15 such that injector 40 can inject fuel directly into air shaft 46. Fuel pump (not shown) is controlled by ECU 12 and supplies pressurized fuel to fuel rail 44, which in turn supplies fuel to injector 40. Preferably, fuel pump (not shown) is a pulse pump, which pulses the fuel either synchronized with the injector pulses or unsynchronized depending on the desired pressure and fuel flow, but an ordinary fuel pump as used in traditional systems can also be used.

In normal operation, ECU 12 controls the air and fuel mixture by controlling the position of throttle plate 32 and injector 40. To control the amount of air entering a cylinder of the engine, ECU 12 signals DC motor 18 to rotate, which in turn rotates worm gear 20. Worm gear 20 rotates sector gear 24, which in turn rotates throttle shaft 33 and ultimately throttle plate 32. Sector gear 24 also comprises an integrated sensor, which senses the position of throttle plate 32 and is in communication with ECU 12. Once integrated sensor of sector gear 24 senses that throttle plate 32 is in the desired position, ECU 12 signals DC motor 18 to cease rotating. ECU 12 determines the desired position of throttle plate 32 through the use of external operator input sensor 42. External operator input sensor 42 communicates with ECU 12 and is connected to operator input hookup 38, which is attached by a cable to an operator input, such as a gas pedal or engine speed control. The user of the engine pushes the gas pedal or selects the desired engine speed control, which is relayed to operator input sensor 42 by the connected cable moving the position of operator input hookup 38. Operator input sensor 42 signals to ECU 12 how much throttle the user desires. ECU 12 sends a signal to DC motor 18 to position throttle plate 32 at the position that corresponds to the user's desired amount of throttle. ECU 12 controls the amount of fuel entering a cylinder of the engine by controlling injector 40, and opening injector for a specific time to allow the desired amount of fuel to be injected into the air stream. ECU 12 monitors the various sensors continually and is capable of adjusting the position of throttle plate 32 and the amount of injected fuel several times per second to achieve optimal operating efficiency.

Figure 2:
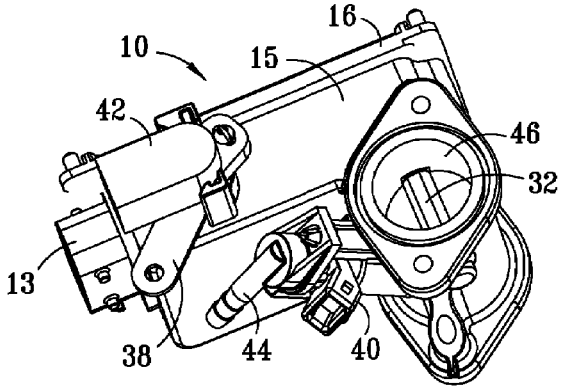
FIG. 2 is a perspective view of the fuel injection system of FIG. 1
Figure 3:
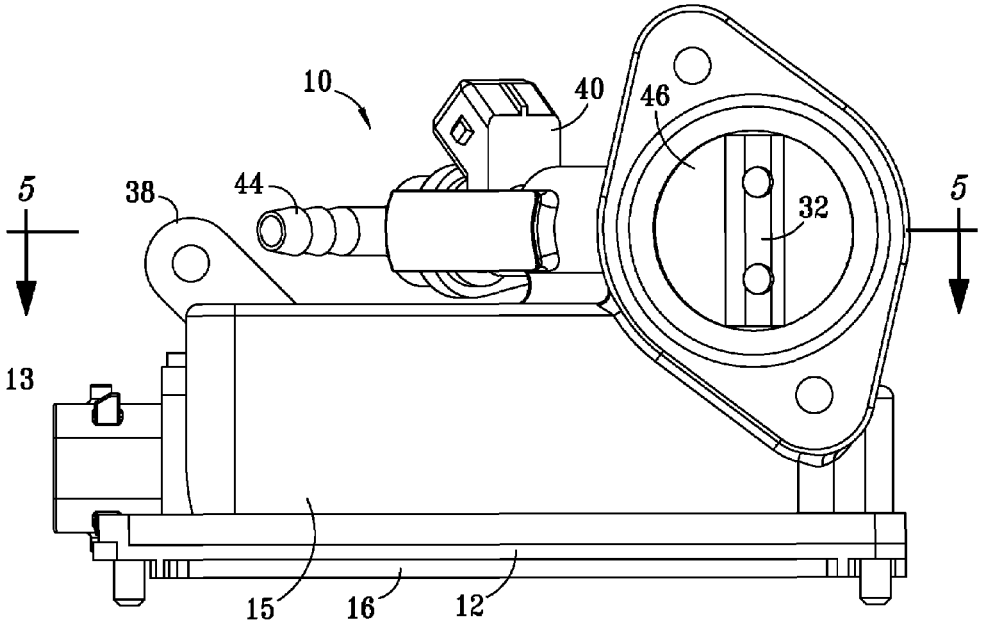
FIG. 3 is a side elevation view of the fuel injection system of FIG. 1.
Figure 4:
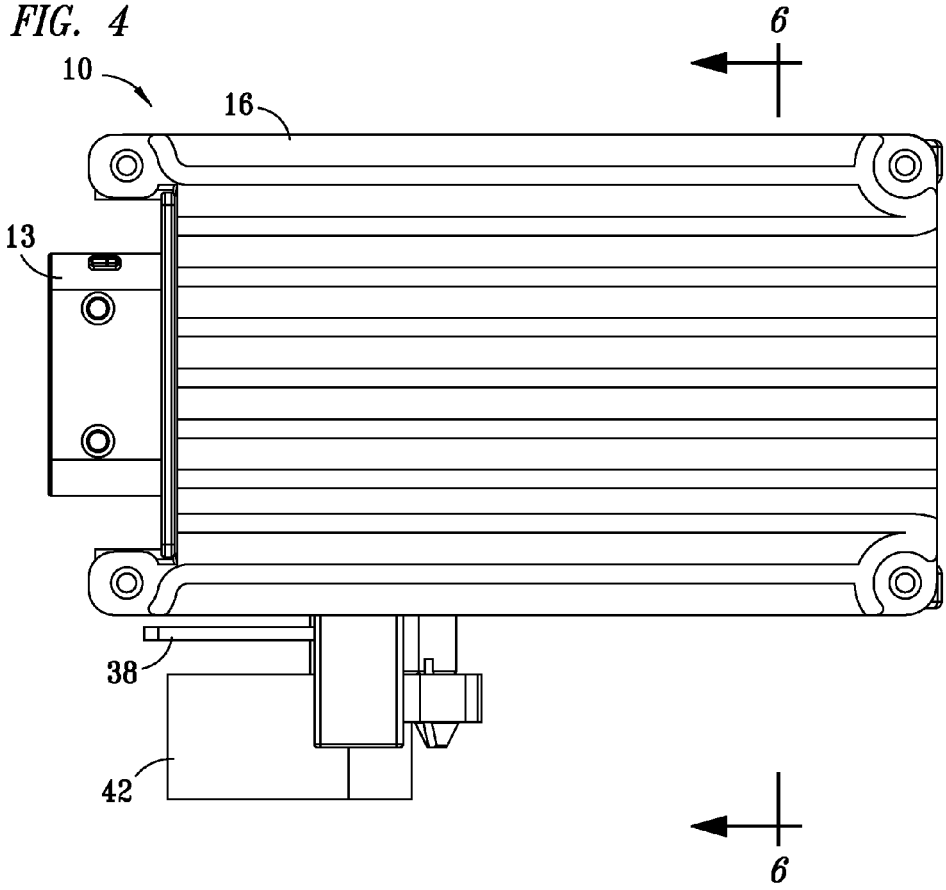
FIG. 4 is a top view of the fuel injection system of FIG. 1

Referring to FIGS. 2, 3 and 4, assembled fuel injection system 10 is shown. ECU cover 16 and ECU 12 are attached to throttle body housing 15, and ECU electrical connector 13 is outside throttle body housing 15 to allow for ECU to be plugged in and powered. Throttle plate 32 is shown in its closed position, where it is perpendicular to and blocking the flow of the air stream through air shaft 46. Fuel rail 44 is attached to and in fluid communication with injector 40, which is positioned to inject fuel directly into air shaft 46. Operator input hookup 38 is attached to external operator input sensor 42, which is mounted on the side of throttle body housing 15.

Figure 5:
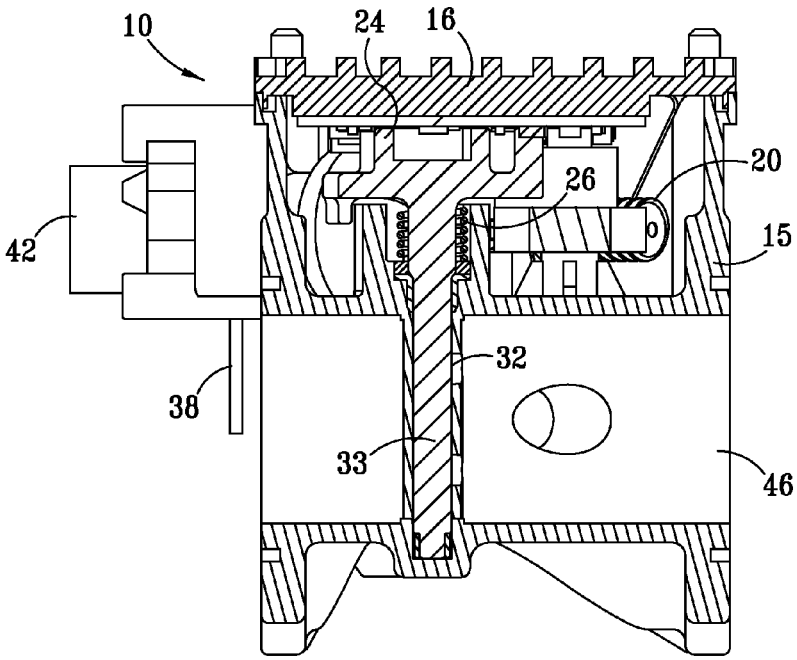
FIG. 5 is a cross-sectional view of the fuel injection system of FIG. 1 taken along line 5-5 of FIG. 3.

Referring to FIG. 5, a cross-sectional view of fuel injection system 10 is shown. ECU cover 16 and ECU (not shown) are attached to throttle body housing 15. Operator input hookup 38 and external operator input sensor 42 are shown attached to the side of throttle body housing 15. Worm gear 20 is turned by DC motor (not shown), which then turns sector gear 26. As sector gear 26 rotates, spring 26 is compressed and throttle shaft 33 is rotated. Throttle shaft 33 is attached to throttle plate 32, and as throttle shaft 33 rotates, throttle plate 32 also moves from a closed position in which throttle plate 32 is perpendicular to the air flow in air shaft 46 to a full-open position in which throttle plate 32 is parallel to the air flow in air shaft 46.

Figure 6:
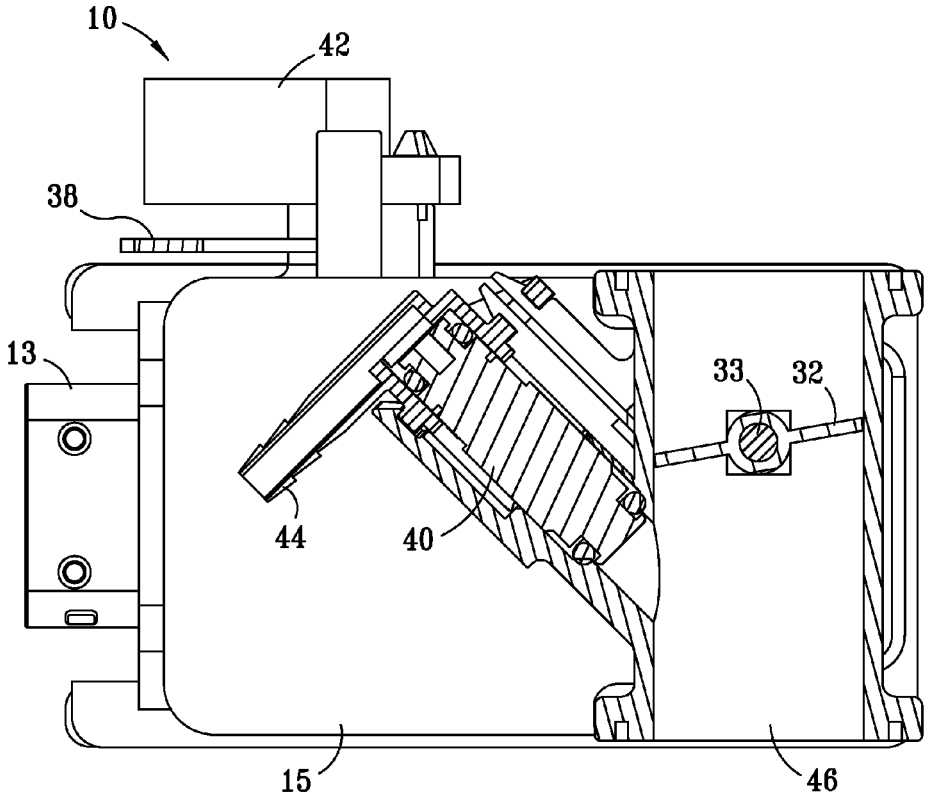
FIG. 6 is a cross-sectional view of the fuel injection system of FIG. 1 taken along line 6-6 of FIG. 4.

Referring to FIG. 6, an additional cross-sectional view of fuel injection system 10 is shown. ECU electrical connector 13 can be seen extending from throttle body housing 15, and operator input hookup 38 and external operator input sensor 42 are shown attached to throttle body housing 15. Throttle shaft 33 is attached to throttle plate 32 along the vertical diameter of throttle plate 32 and both throttle shaft 33 and throttle plate 32 are located inside air shaft 46. Throttle plate 32 is shown in its closed position in which air flow is blocked through air shaft 46. Fuel rail 44 is shown in fluid communication with injector 40. Injector 40 is integrated into throttle body housing 15 in a position such that injector 40 can inject fuel directly into the air stream passing through air shaft 46.

Other alterations and modifications of the invention will likewise become apparent to those of ordinary skill in the art upon reading the present disclosure, and it is intended that the scope of the invention disclosed herein be limited only by the broadest interpretation of the appended claims to which the inventors are legally entitled.

The invention claimed is:

1. A fuel injection system for internal combustion engines comprising:

a polymeric housing comprising a throttle body and an ECU case releasably engageable with the throttle body portion;

the throttle body further comprising a selectively positionable throttle, a contactless throttle position sensor that directly senses the position of the throttle and an integrally mounted injector;

the ECU case comprising an ECU and a built-in temperature sensor, throttle position controller, throttle position sensor pump controller, ignition driver and pulse fuel pump;

a fuel pump supplying fuel to the injector; and a fuel rail providing fluid communication between the fuel pump and the injector.

2. The fuel injection system of claim 1 wherein the engine has one cylinder.

3. The fuel injection system of claim 1 wherein the engine has two cylinders and the injector supplies fuel to both cylinders.

4. The fuel injection system of claim 1 wherein the engine has more than two cylinders and the injector supplies fuel to all cylinders.

5. The fuel injection system of claim 1 wherein the ECU case further comprises an integrated speed control.

6. The fuel injection system of claim 1 wherein the ECU is capable of adjusting fuel flow based on operating altitude.

7. The fuel injection system of claim 1 wherein the throttle is selectively positionable by electronic activation.

8. The fuel injection system of claim 1 wherein the throttle is selectively positionable by a mechanical linkage.

9. The fuel injection system of claim 1 wherein the fuel is selected from a group consisting of gasoline, ethanol, and mixtures thereof.

10. The fuel injection system of claim 1 wherein the engine has an intake manifold and the polymeric housing is releasably attachable to the intake manifold.

11. The fuel injection system of claim 9 wherein the polymeric housing is attachable to the intake manifold in a space that is otherwise provided for a carburetor.

12. The fuel injection system of claim 1 wherein the fuel pump is connected to the polymeric housing.

13. The fuel injection system of claim 1 wherein the fuel pump is an integral part of the polymeric housing.

14. The fuel injection system of claim 1 wherein the fuel pump comprises a polymeric body attachable to the polymeric housing.

15. The fuel injection system of claim 1 wherein the fuel rail comprises a polymeric body attachable to the injector.

16. The fuel injection system of claim 1 wherein the ECU is capable of adjusting fuel flow based on the fuel being used.

17. The fuel injection system of claim 1 wherein the pulse fuel pump is controlled by the ECU.

* * * * *